United States Patent [19]

Bechtiger et al.

[11] 4,375,159

[45] Mar. 1, 1983

[54] CHANGEABLE COMBINATION TUMBLER WHEEL TYPE KEY LOCK

[75] Inventors: Charles G. Bechtiger, La Chaux-de-Fonds; Jacques Peyronnet, Pully, both of Switzerland

[73] Assignee: Sargent & Greenleaf, Inc., Nicholasville, Ky.

[21] Appl. No.: 230,033

[22] Filed: Jan. 28, 1981

[51] Int. Cl.[3] ..... E05B 15/14; E05B 19/02; E05B 29/00

[52] U.S. Cl. ..... 70/366; 70/326; 70/392; 70/403; 70/409

[58] Field of Search ..... 70/316, 366, 340, 347, 70/349, 353, 355, 303 A, 303 R, 365, 317, 318, 324, 384, 403, 409, 326, 392

[56] References Cited

U.S. PATENT DOCUMENTS

| | | | |
|---|---|---|---|
| 3,073,145 | 1/1963 | Potzick | 70/303 A |
| 3,373,583 | 3/1968 | Parrock | 70/303 R |
| 3,991,596 | 11/1976 | Gartner | 70/303 A |
| 4,142,388 | 3/1979 | Phillips et al. | 70/316 |

FOREIGN PATENT DOCUMENTS

| | | | |
|---|---|---|---|
| 268587 | 12/1913 | Fed. Rep. of Germany | 70/409 |
| 264540 | 10/1949 | Fed. Rep. of Germany | 70/355 |

*Primary Examiner*—Thomas J. Holko
*Assistant Examiner*—Lloyd A. Gall
*Attorney, Agent, or Firm*—Mason, Fenwick & Lawrence

[57] ABSTRACT

A tubular wheel type key lock operable by a key, comprising a lock case, a plurality of peripherally gated tumbler wheels supported for rotation about a common axis. Each tumbler wheel include center hub portions and rim portions encircling the hub portions. Supporting formations are interposed between successive adjacent pairs of tumbler wheels defining spacers to rotatably support the tumbler wheels about a common center axis. A control cam mechanism is rotatable by a key and has means to link with a fence lever for retracting a bolt at a predetermined position of the tumbler wheels.

20 Claims, 9 Drawing Figures

11
14
10
15
13a
34
44b
44
44a
45
44c
42a
42
42b
12

3
14
35b
35
36
13a
35a
38f
22'
39c
38c
34
3
22a
39a
39b
21
37
41
22'
22b
22'
38b
39
22c
50
38j
21
14a 13b
40c
41
40
46
15
35
20
21
13a
18c
20
19
36
34
17
31
20
18
18c
19
31
31
11
45
44a
29
12

Fig-6
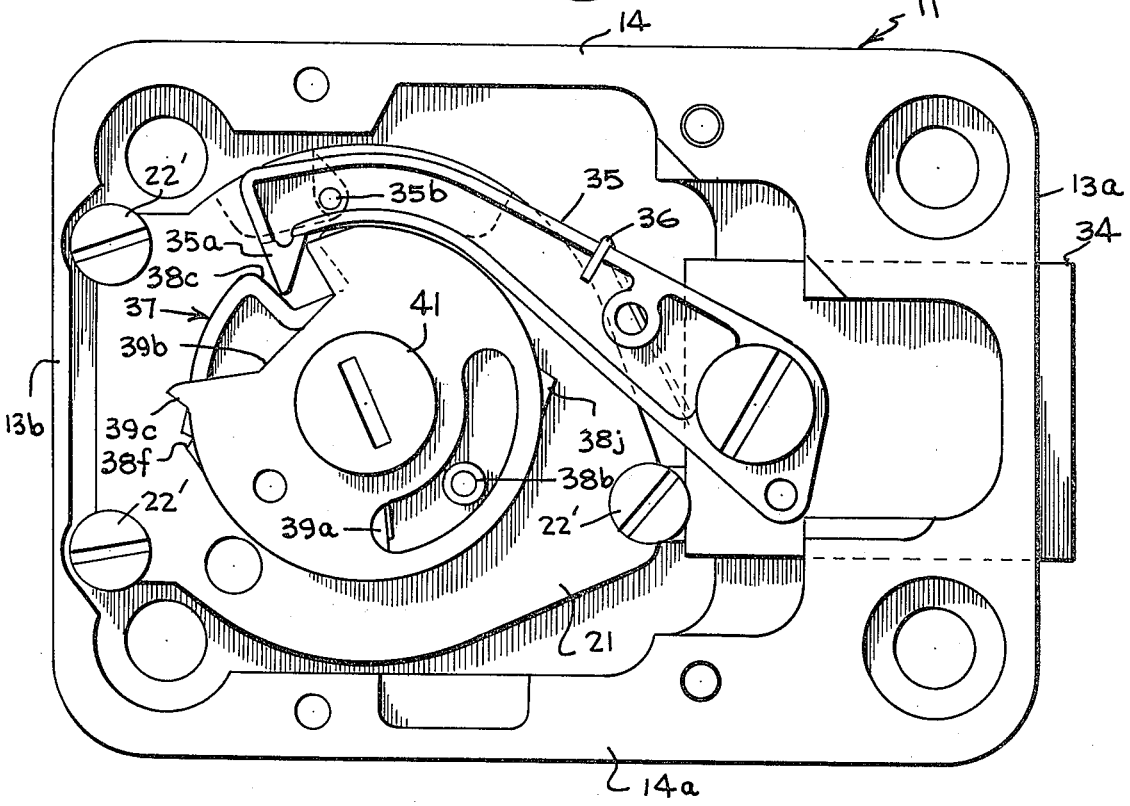
Fig-7
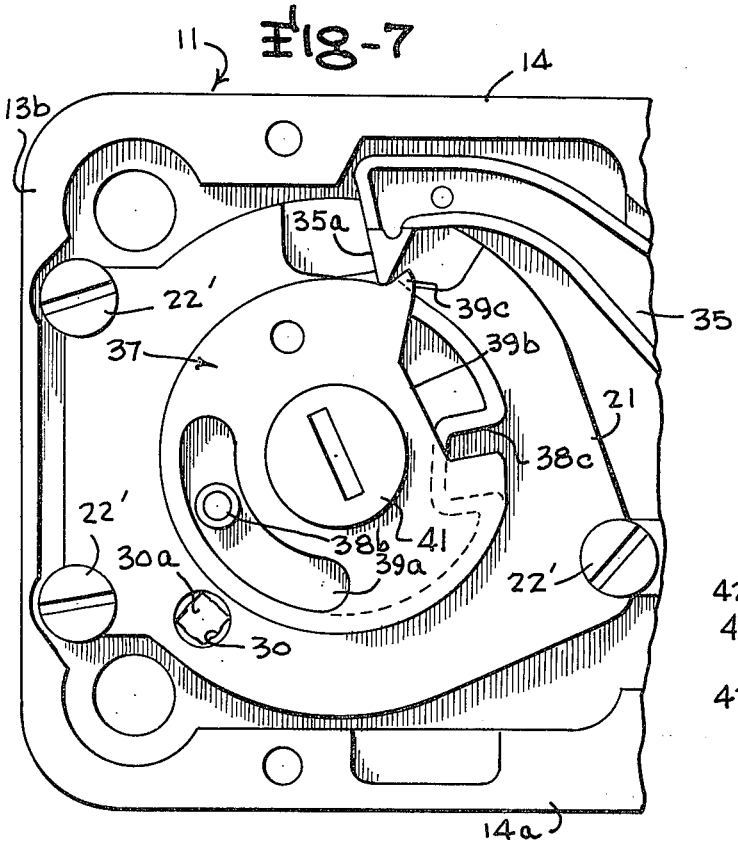
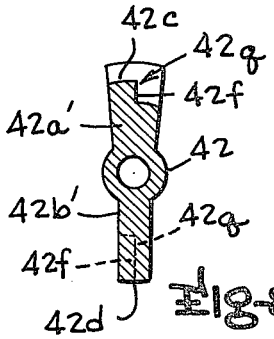
Fig-8A
Fig-8B
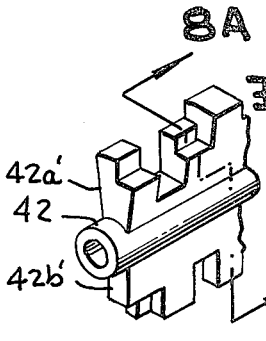

CHANGEABLE COMBINATION TUMBLER WHEEL TYPE KEY LOCK

BACKGROUND AND OBJECTS OF THE INVENTION

The present invention relates in general to tumbler wheel type changeable key operated locks having component structure similar to dial operated tumbler wheel combination locks, and more particularly to changeable combination key locks of the type having a plurality of peripherally gated tumbler wheels with hub portions selectively changeable relative to their peripheral gated portions, adapted to be conditioned upon manipulation of a key inserted therein to assume positions appropriate to the salients or bits of the particular key therein for setting the lock to the key configuration.

Conventionally, key locks usually employ pivoted lever tumblers or axially slideable pin tumblers to engage the contoured edge of the key blade or bit portion which adjust the lever tumblers or pin tumblers to positions releasing the lock to a condition so that the bolt can be retracted or moved to unlocking position. These key operated locks are usually of an entirely different construction and operation in accordance with different principles from conventional locks of the class known as tumbler wheel combination locks. Tumbler wheel combination locks usually comprise three or more tumbler wheels which are loosely journaled in coaxial, side-by-side spaced relation for rotation within a lock casing on a tubular arbor or post projecting inwardly from the front wall of the casing. The lock dial, which usually has 100 peripheral calibration marks thereon, is affixed to a dial spindle which extends through the bore of the tumbler post and has keyed to the inner end thereof a disc-like drive cam which is likewise arranged coaxially with and spaced rearwardly from the tumbler wheels. A drive pin projects forwardly from the drive cam and has a lost-motion connection through a conventional fly washer or ring with the rearmost tumbler wheel to drive the tumbler wheel in selected relation to the drive cam. A similar lost-motion connection is provided between each of the successive tumbler wheels so that each of the tumbler wheels may be driven upon predetermined rotation of the drive cam to position the peripheral notch or gate in each of the tumbler wheels in alignment with or facing a fence projecting laterally from a fence lever in overlying relation with the tumbler wheel peripheries to receive the fence in the aligned gates. The position of the fence in relation to the length of the fence lever nose is usually such that the fence is slightly spaced from the peripheries of the tumblers when the fence lever nose rides on the periphery of the drive cam.

Heretofore, a tumbler wheel type, changeable combination, key lock adapted for key operation, particularly for use with keys of the European type having bits or salients projecting from diametrically opposite portions of the shaft or stem of the key, has been proposed in earlier U.S. Pat. No. 3,991,596 assigned to the assignee of the present application, wherein tumbler wheels are supported for rotation about their common centers by convex arcuate peripheral wall segment supports guiding and supporting the outer diameters of the tumbler wheels. In such structure however, the friction torques arising from supporting of the tumbler wheels at their outer diameters is such that problems of jamming have occurred, preventing proper operation of the lock. Furthermore, in the structure disclosed in that prior patent, the fence lever was normally releasably latched in a raised inactive position and activated by a release spring and control cam structure to impact against a shoulder formation on the fence lever for releasing the fence lever from is latched condition and impelling it to a coupled relation with the drive cam at a particular angular position of the drive cam and when the fence lever gates were in aligned or facing relation to the fence. Improvement and simplification are desired in the structure for allowing the fence lever nose to only momentarily be accelerated toward the driving cam gate during rotation of the driving cam for coupling with the driving cam gate if the tumbler peripheries are properly aligned with the fence and to prevent fence lever nose coupling with the driving cam gate if the tumbler wheel gates are not properly disposed.

Also, it is an important object of the present invention to provide an arrangement for supporting a stack of tumbler wheels which cannot be supported at their centers, such as in the tumbler wheel key lock application, wherein the friction torque arising from the tumbler wheels is minimized so as to avoid jamming and similar defective operation, by constructing the tumbler wheel and interposing spacers between tumbler wheels in a manner to rotatably support the tumbler wheels at the perimeters of their hub portions rather than at the outer diameters of the outer rim portions of the tumbler wheels.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 6 is a rear elevation view of the driving cam assembly and adjacent portions of the fence lever showing the same in unlocking position with the fence lever nose coupled therein;

FIG. 7 is a rear elevation view similar to FIG. 2 but showing the parts in change key accepting position; and FIGS. 8A and 8B are a transverse section view and a fragmentary section view of a modified key bit for the key lock.

DETAILED DESCRIPTION OF A PREFERRED EMBODIMENT

Figure 1:
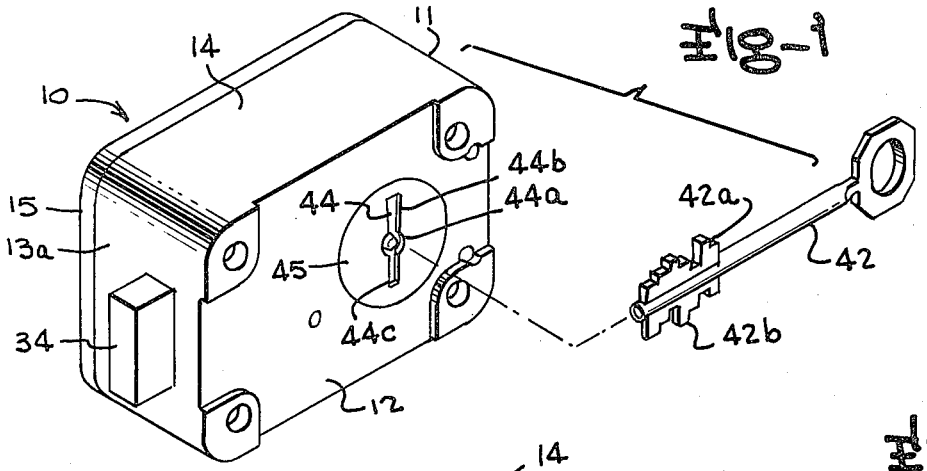
FIG. 1 is a front perspective view of a changeable combination tumbler wheel type key lock constructed in accordance with the present invention.

Referring to the drawings, wherein like reference characters designate corresponding parts throughout the several figures, there is illustrated a tumbler wheel type key lock, generally indicated by the reference character 10, which comprises a rectangular lock case 11 having a front wall 12 and rearwardly projecting end walls 13,13*a* and top and bottom walls 14 and 14*a* defining a mechanism chamber therebetween which is rearwardly closed by a cover plate 15. The lock casing may be mounted against the inner surface of a door or other closure in the conventional manner, as by mounting screws extending through screw holes near the corners of the lock case and into the supporting door or panel. A stack or bank of side-by-side tumbler wheels 17, seven of which are provided in the illustrated embodiment, and each comprising a hub portion 18 and an encircling outer rim portion 19, are supported for rotary movement about their center axes by and between a plurality of supporting guide plates 20 interposed between the respective tumbler wheels 17, and by a rear stack cover 21 of similar peripheral configuration. The array of supporting guide plates 20 and stack cover 21 are themselves guided and secured by three mounting pillars or posts 22*a*,22*b* and 22*c*, as by providing the guide plates 20 and stack cover 21 with concave sockets or recesses 24 at appropriate locations to receive the cylindrical mounting pillars or posts 22*a–c* recessed therein.

The tumbler wheels 17 generally resemble changeable tumbler wheels usually employed in combination locks, in that they comprise the inner hub portion 18 having a serrated annular band portion 18*a* which is engaged by similar teeth on the jaw formation 25 at the free end of the integral, elastically deformable arcuate elongated locking arm 26 integrally formed with the tumbler wheel rim portion 19. Each hub 18 is also formed with a smooth periphery cylindrical annular end portion 18*b* adjoining the serrated band 18*a* and an outwardly projecting shallow annular flange 29 at its other end forming a shoulder against which the thinner annular rim 19 rests. The rim portion 19 is formed as a one-piece, relatively thin planiform metallic annular plate or ring having a circular outer periphery 19*a* interrupted by a shaped fence receiving gate 27 and having a generally circular center hole 28 of appropriate inner diameter to rotatably interfit on the serrated band 18*a* of the associated hub 18 and an eccentric change cam 30 in the form of a bushing or collar having a square or nonround center opening 30*a* and a circular collar portion 30*b* is rotatably journaled in a similar diameter round hole in the rim portion 19 of the tumbler wheel assembly and includes a flat 30*c* which projects across the curved slot 19*b* outwardly bounding the curved locking arm 26 to bear against the locking arm near its midportion between the jaw formation 25 and its root end 26*a*.

Figure 3:
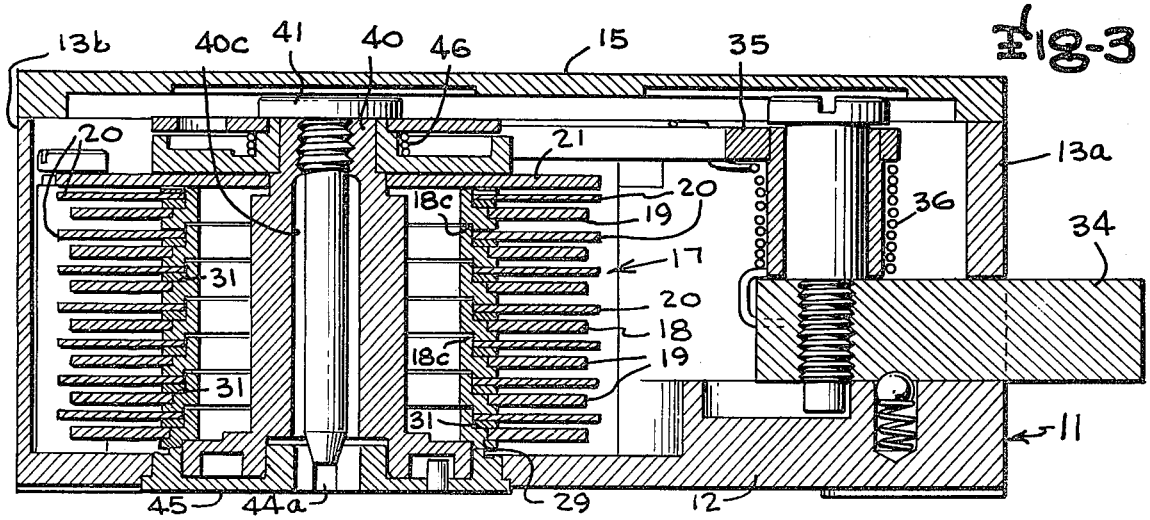
FIG. 3 is a horizontal section view, taken along the line 3—3 of FIG. 2.

As is apparent from FIG. 3, the tumbler wheels 17 are stacked in a side-by-side array with a thin spacer washer 31 also encircling the smooth annular end portion 18*b* of each respective tumbler wheel hub located between one side of the associated tumbler wheel rim portion 19 and the rearwardly adjacent guide plate 20 outwardly surrounding the end portion 18*b* projecting rearwardly beyond the guide plate 20 and extending into the cylindrical forwardly facing well formation 18*c* in the next rearwardly adjacent tumbler wheel hub 18.

It will be apparent that by this arrangement, the bounding walls of the center holes 28 of the supporting guide plates 20 between the successive tumbler wheel hub portions in the stacked array which correspond closely to the outer diameter of the annular cylindrical end portion 18*b* support and journal the tumbler wheels at the perimeters of the hubs 18 rather than at the outer diameters of the rim portions 19, thus minimizing the friction torque. In this manner, the radius of the torque arms for this friction torque force, which is only the radius of the hub portion rather than the radius of the total tumbler wheel assembly, is only about half the torque radius which is encountered if the tumbler wheels are rotatably supported at their outer peripheries.

Figure 4:
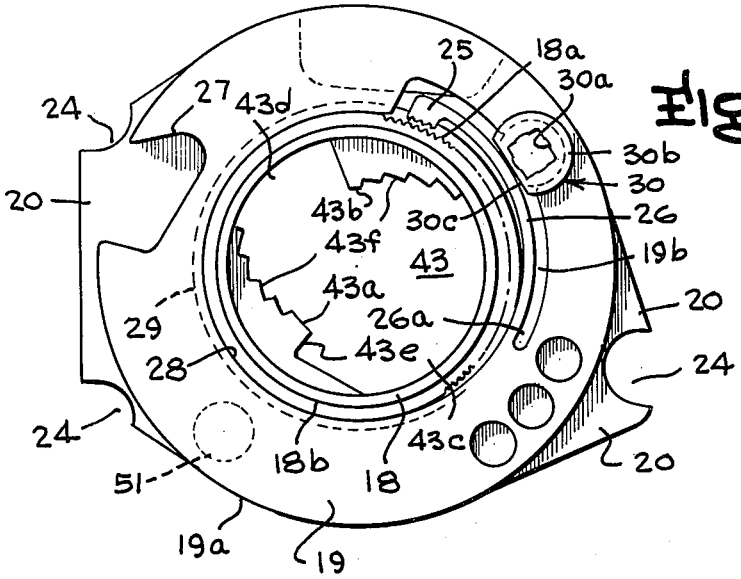
FIG. 4 is a rear elevation view of one of the tumbler wheels, showing details of the hub portion and rim portion structure thereof.

The outer annular rim portions 19 are, in this form, selectively locked against rotation relative to their supporting hubs 18 by the locking arms 26, which are integral with the remainder of the rim portions but are sufficiently narrow in the portions of the locking arms occurring between the jaw formations 25 and their root ends 26*a* to permit the jaw portions to be moved toward and away from the edge of the hub, and the change cam 30 which is rotatably supported in the associated rim portion 19 normally occupies a position stressing the jaw portion 25 into locking relation with the serrated teeth 18*a* of the associated hub 18. However, when the flat 30*c* of the eccentric change cam 30 is rotated by a change key inserted through the nonround center opening in the change cam 30 to engage the crest or outer convexly curved midportion of the locking arm 26 as shown in FIG. 4, the inherent elasticity of the locking arm 26 causes it to withdraw to its normal unstressed position retracting the jaw formation 25 from interlocking engagement with the serrated band 18*a* of the associated tumbler wheel hub 18. When the change cam 30 is rotated back to a position approximately 90° from that shown in FIG. 4, wherein the uninterrupted circular outer diameter portion of the change cam 30 engages the midportion of the locking arm 26, the locking arm is deformed along its center region toward the center of the associated hub bringing the jaw formation 25 into tight interlocking relation with the hub serrated band 18*a*. By locating the eccentric change cam 30 so as to engage and push inwardly on the midregion of the elongated curved locking arm 26, the locking arm itself can yield, and thus if the teeth on jaw formation 25 do not correctly mesh with the teeth 18*a* of the hub 18 such yielding avoids damage to the teeth, whereas if the locking arm 26 were pressed directly by the cam 30 close to the jaw formation portion 25 and meshing zone the teeth may be crushed if they did not correctly mesh.

As illustrated, the stack of tumbler wheels 17 and supporting guide plates 20 is completed by assembling the tumbler wheels 17 and supporting guide plates 20 in alternating fashion onto the mounting pillars 22*a*,*b* and *c*, then assembling a thin wavy torque washer 32 onto the rearwardly protruding serrated hub portion of the rearmost tumbler wheel assembly extending rearwardly beyond the rearmost guide plate 20, and fixing this stack in position by installing the stack cover 21 rearwardly over the array and installing the three mounting screws 22' on the mounting pillars 22*a*,*b* and *c*.

Figure 2:
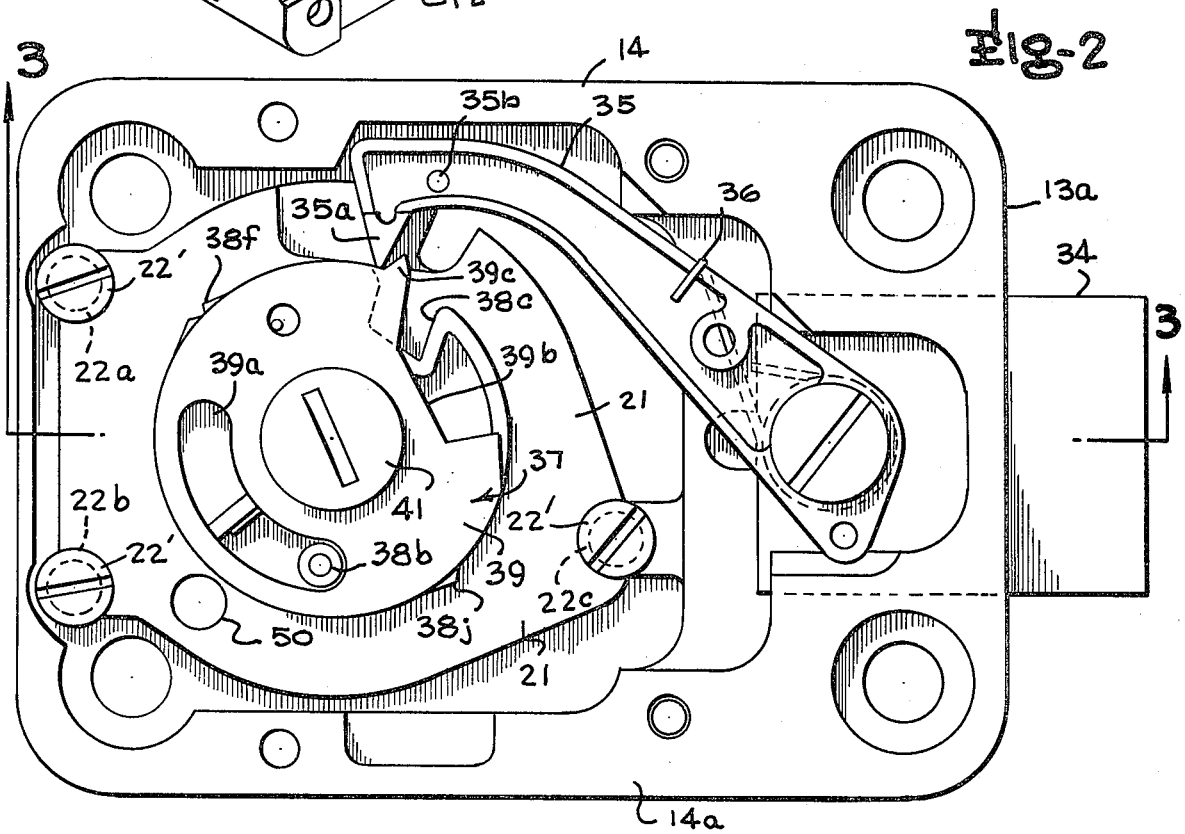
FIG. 2 is a rear elevation view of the tumbler wheel type key lock, with the rear cover removed, showing the lock in locked condition.

The lock is provided with a bolt 34 which is adapted to slide in a suitable guideway formed in the end wall 13*a* of the lock casing. The bolt 34 is operated by means of a fence lever 35 which is pivotally attached to the bolt by a screw and is normally resiliently biased by a torsion spring 36 surrounding the fence lever pivot screw in a downward or counterclockwise direction as viewed in FIG. 2 to impel the fence lever nose 35*a* toward the peripheries of a driving cam assembly 37 and fence 35*b* toward the peripheries of the tumbler wheels 17. The fence 35*b* is adapted to be received in the peripheral gates, for example as shown at 27, of the rim portions 19 of the tumblers when the tumbler gates are disposed in registry with each other at a chosen angular position facing or aligned with the fence 35*b*.

The driving cam assembly 37 is rotatably supported in the lock casing by fitting the assembly of the driving cam plate 38 and inhibition disc 39 onto the rearwardly projecting, slightly smaller diameter end portion of a rotatable slotted key arbor or channel 40. In the illustrated embodiment, the smaller diameter rear end formation 40*a* of the key arbor 40 is provided with a flat along a part of the circumference thereof which mates with a similar flat in the center hole 38*a* of the driving cam plate member 38 to prevent rotation of these two components relative to each other, and the driving cam plate 38 and disc 39 assembled therewith are removably assembled on the rear portion of the key arbor 40 by a screw 41 assembled in a threaded socket or opening in the center of the rear end portion of the key arbor 40 and having a head which is of sufficient diameter to retain the driving cam assembly 37 on the arbor 40. If desired, the screw 41 may have a forwardly projecting elongated cylindrical shank or rod portion extending substantially to the front wall of the lock case to form a guide pin for a center bore in the key to properly guide and journal the key in the keyway. The key arbor 40 has appropriately located, diametrically opposite axially elongated slots communicating with the central key-receiving bore 40*c* in the arbor to accommodate the oppositely projecting bits 42*a* and 42*b* of the key illustrated at 42 in FIG. 1.

Figure 5:
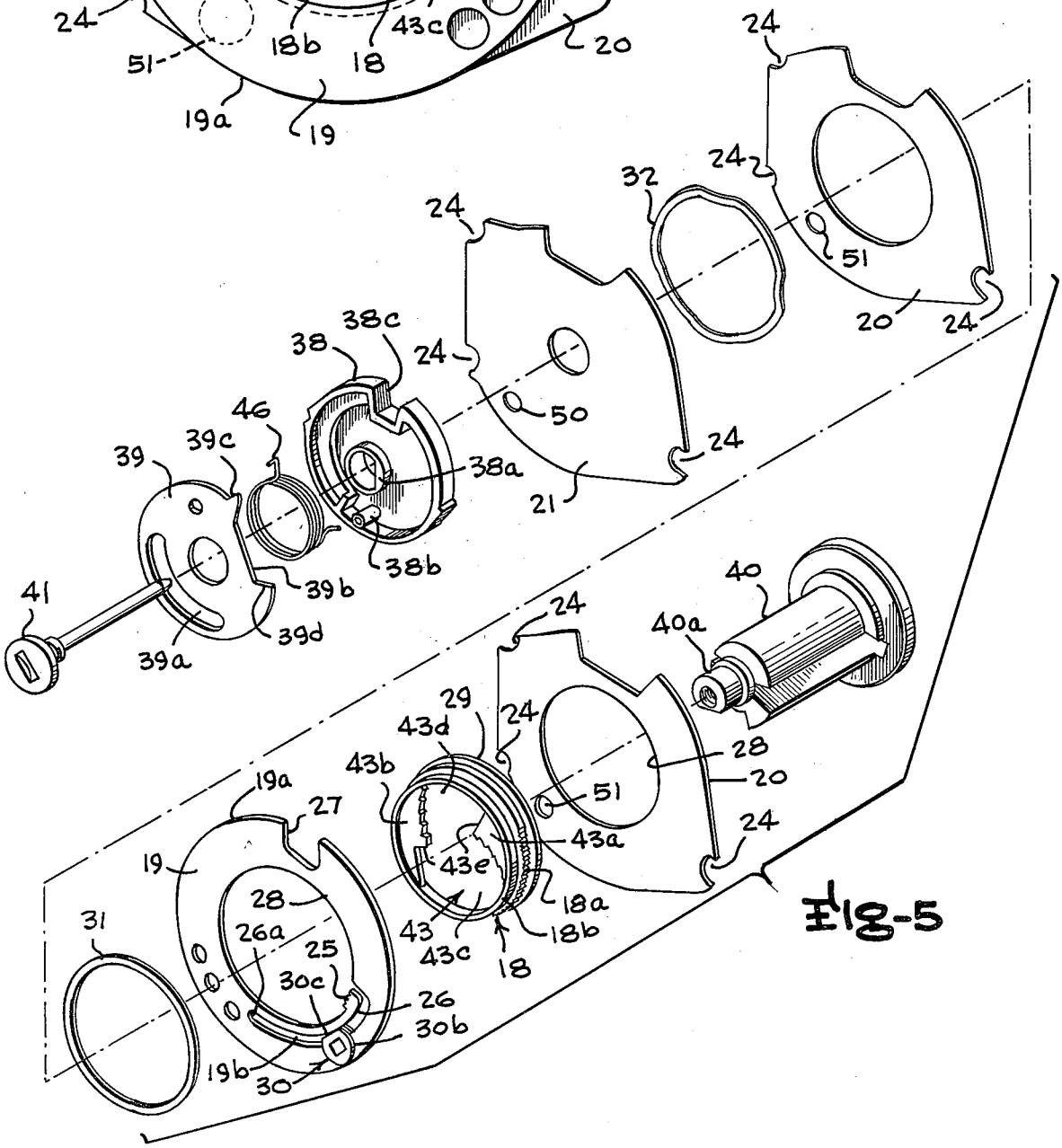
FIG. 5 is an exploded perspective view of the components of the driving cam and inhibition disc assembly and of the rearmost tumbler wheel and associated pair of spacing guide plates associated therewith.

The hubs 18 of the tumbler wheels 17 are provided with shaped apertures 43, the shape of which is best shown in FIGS. 4 and 5. These shaped apertures 43 are all of the same configuration, in the illustrated embodiment, and are contoured to provide a pair of angularly displaced fan-shaped stepped sector formations 43*a*,43*b* extending through about a 90° quadrant each between which are spaces, indicated at 43*c*,43*d* having a radius slightly greater than the radius of the longest key bits 42*a*,42*b* to be provided on any keys useable with the lock. The sector formations 43*a*,43*b* each terminate in a straight radial shoulder 43*e* along substantially diametrically opposite radii at a corresponding side of the spaces 43*c*,43*d* to be engaged by the salient radial wall 40*b* of arbor 40 upon clockwise rotation of the key as viewed in FIG. 4, and having stepped shoulders 43*f* at the other side of the sector formations 43*a*,43*b* to be engaged by the key bits 42*a*,42*b* upon counterclockwise rotation of the key as viewed in FIG. 4. The stepped shoulders or sides 43*f* progress in radial step increments from a maximum radial dimension for the key bits to a minimum radial dimension for the key bits in accordance with the customary incremental steps in the radial sizes of key bits for such types of keys. The transition shoulders defined between the successive incremental radial steps making up the stepped shoulders 43*f* are spaced circumferentially from each other progressing in a clockwise direction from the largest radial segment, as viewed in FIG. 4, so that the circumferential or angular position of the hub 18 associated with each different radial length key bit will be slightly different. It will be apparent, therefore, that upon insertion of a key into the key aperture and rotation of the key in a counterclockwise direction as viewed in FIG. 4 to bring all of the key bits into abutment with the transition shoulder of the incremental step along shoulder 43*f* sized to correspond to the bit length will cause the hubs 18 to occupy different angular positions in accordance with the sizes of the key bits.

The keyway entrance opening, indicated at 44 which may, for example, be formed in a circular disc or plate portion 45 fixed in the front wall of the lock case, is of special shape providing a circular center portion 44*a* for the shank of the key and diametrically opposite upward and downward extending wing portions 44*b* and 44*c* to receive the wards or bits 42*a* and 42*b* of the key 42. It will be noted that the shape of the downwardly extending wing portion 44*c* of the key entrance 44 is rectangular in shape with its two sides parallel to each other, while the upwardly extending wing portion 44*b* of the key entrance 44 is of truncated triangular configuration with its sides diverging upwardly to correspond to a similar cross-sectional configuration of the key bits 42*a* extending in one radial direction from the key shank. This construction is provided to prevent withdrawl of the key when it has been turned through 180° from its proper entrance position, as the truncated triangular cross-section key bits 42*a* would then be aligned with the downwardly extending rectangular shaped entrance wing portion 44*c* and therefore could not be withdrawn through the entrance portion 44.

Manipulation resistant features are incorporated in the key lock by virtue of the particular construction of the driving cam assembly made up of the driving cam plate 38 and disc portion 39. The driving cam plate 38 and disc portion 39 are linked together by a spring 46, and the driving cam plate 38 includes a rearwardly projecting driving pin formation 38*b* which extends into an arcuate slot 39*a* on the disc portion 39. The disc portion 39 includes a specially shaped gate 39*b* which is of larger circumferential extent than the gate 38*c* of the driving cam plate 38 and is bounded at one end by a tooth or trip formation 39*c*. The driving cam plate 38 and inhibition disc 39 are linked together by the spring 46 so that when the driving cam is driven counterclockwise by the key channel or arbor 40, the inhibition disc 39 follows the rotation of the driving cam plate portion 38 until its tooth 39*c* reaches the fence lever nose and the two parts releasably lock each other by abutment (at the FIG. 2 position). From this time on, the driving cam plate 38 rotates alone until its drive pin formation 38*b* moving in the slot 39*a* of the inhibition disc 39 reaches the end of the slot, whereupon the key torque is now transmitted to the inhibition disc 39 causing the fence lever to be pushed outwardly by the tooth or trip formation 39*c* on the inhibition disc 39. As soon as this tooth formation 39*c* has passed beneath the fence lever nose, the inhibition disc 39 accelerates under the torque from its spring 46, and for a short duration the gate 38*c* of the driving cam plate 38 is unlocked by the gate formation 39*b* of the inhibition disc 39. If the proper key whose bits correspond to the key code for the tumbler wheel hub portion has been inserted and rotated counterclockwise in the keyhole, the fence lever 35 falls into the gates of the tumbler wheel rim portions 19 during the short moment the driving cam gate 38*c* is open, because of the spring force of the fence lever torsion spring 36, permitting retraction of the bolt by the drive cam 37, as shown in FIG. 6. The forces and inertias of the fence lever, the inhibition disc and their associated springs are such that the fence lever is faster and falls before the inhibition disc blocks anew the gate of the driving cam plate 38. If, however, the key bit code is wrong for the particular setting of the tumbler wheel hubs 18, the fence lever 35 falls when the inhibition disc gate 39b aligns momentarily with the driving cam plate gear 38c until its fence 35b touches the peripheries of the tumbler wheels in the stack, and the inhibition disc 39 driven by its spring 46 turns counterclockwise back to its zero position relative to the driving cam plate portion 38 and pushes the fence lever out of contact by the action on the fence lever nose of the ramp 39d of the inhibition disc gate 39b. Thus the fence 35 is allowed to touch the peripheries of the driving wheels only for a very short time, just long enough for the fence to detect that the tumblers are not set in accordance with the proper opening code.

It will be noted that the rear stack cover plate 21 and each of the spacer and guide plates 20 have a circular aligned change key opening 50,51 respectively which registers with a change key hole of conventional design (not shown) in the rear cover plate 15 of the lock case. These combination change key holes 50,51 do not register with the nonround center opening 30a in the change cams 30 in the rim portion of each tumbler wheel rim portion 19 at either the zero position of the tumbler wheels where the tumbler wheels are properly aligned to receive the key 42 (for example the FIG. 2 position) or at the bolt retracted unlocked position of the tumbler wheels, illustrated in FIG. 6, or at the position where the driving cam gate 38c is momentarily exposed to receive the fence lever nose. In the preferred embodiment, the extent of rotation of the key from the insertion position, considered as the zero position of the tumbler wheels, to the fully unlocking and bolt retracted position of FIG. 6 is somewhat in excess of 270°. At the 180° position of the key 42 relative to the zero or insertion position, the change cams 30 in the rims 19 of each of the tumbler wheels all come into registry with the change key holes 50,51 in the stack cover plate 21 and guide plates 20, which is designated as the change position of the tumbler wheels. This 180° rotation of the key and the driving cam assembly is also identified by a detent formation 38f on the perimeter of the driving cam plate 38, formed of two shallow outwardly extending ramp formations with a notch between them, into which the sharp lower edge of the fence lever nose 35a drops, producing a faintly noticeable detenting of the driving cam assembly at this 180° position. The driving cam plate is also provided with a further shallow ramp detent formation 38j spaced approximately 180° in circumference around the drive cam periphery from the change position detenting notch 38f.

To effect change of the combination so as to adapt the combination lock to accept and be operated by a key having a different bit coding, the old key for which the lock is already coded is inserted into the entrance opening 44 and the key is rotated clockwise when viewed from the front side of the lock (or counterclockwise when viewed from the rear as in FIG. 2), until the fence lever nose 35a detents in the detent notch 38f, at which position the key bits or wards 42a,42b are respectively aligned with the key entrance wings 44c,44b, and the nonround center openings 30a in the change cams 30 of each of the tumbler wheel rim portions are all located in registry with the change key opening in the rear cover plate 15 of the lock. It will be noted that the key cannot be inadvertently removed from the lock at this position, since the key bits 42a having the slightly outwardly diverging side faces are registered with the parallel side wing 44c of the key entrance opening preventing key withdrawal.

The change key is then inserted through the change cams and rotated through 90°, shifting the change cams 30, which had been strongly pressing the locking arms 26 into locked relation with the hubs 18 to the position illustrated in FIG. 4 wherein the flats 30c are rotated into position disposed against the midportion of the locking arms 26, and the locking arms 26 are allowed to withdraw the teeth of their jaw formations 25 from meshing engagement with the teeth 18a of the tumbler wheel hubs 18, because of their inherent elasticity. The old key is then returned back to the zero position and withdrawn from the key arbor 40 and key entrance opening 44, and the new key, with a different code, is inserted and turned by 180° (clockwise when viewed from the front or counterclockwise when viewed from the rear). This orients the tumbler hubs, because of engagement of the new key bits or wards 42a,42b with the appropriate steps of the hub formations 43a,43b, to the proper angular position for the new key code, and the change key is then rotated through 90° back to its original position and withdrawn. This reverse rotation of the change key rotates the tumbler wheel change cams 30 to rotate their flats from engagement with the locking arms 26 and bring their circular peripheral portions against the locking arms, and thus force the locking arm jaw formations 25 back into interlocked relation with the teeth 18a of the hubs. The new key 42 is then returned to the zero or insertion position and withdrawn from the key opening and the lock is now set for the new key code.

A further modification of keys for the lock described in FIGS. 1–7 as illustrated in FIGS. 8A and 8B, designed to provide twice as many possible key combinations as with the regular cut key of the type illustrated in FIG. 1. In the improved side cut key of the type illustrated in FIGS. 8A and 8B, the key bits or wards 42a',42b' projecting diametrically oppositely from the round cross-section shank or stem 42 are of an isosceles trapezoidal or truncated triangular initial cross-section for the uppermost bits or wards 42a and of a rectangular cross-section having parallel side faces for the lower bits or wards 42b, but also include, in addition to cuts of predetermined incremental depths at the outermost edges 42c,42d made in the usual manner, side stepped cuts or rabbets, as indicated at 42e,42f, as best shown in FIG. 8A, whose depth radially of the axis of the key shank or stem 42 corresponds to the height of a step shoulder 43f of the hub shoulder formations 43a,43b and which spans half the transverse thickness of the bit portion in which the side cut occurs. For example, in the form shown in FIG. 8B, the transition wall or shoulder, indicated at 42g coincides substantially with the radial midplane of the respective bits or wards 42a',42b' intersecting the center axis of the shank or stem 42. In this manner, using the same hub and rim structure as the tumbler wheel assemblies described hereinabove, and thus double the tumbler wheels combination capability.

What is claimed is:

1. A tumbler wheel type key lock operable by a key, comprising a lock case, a plurality of peripherally gated tumbler wheels supported for rotation about a common axis and each including center hub portions and rim portions encircling the hub portions, the key having an elongated shank and a plurality of wards projecting therefrom insertable into the center hub portions of the tumbler wheels, the center hub portions having shaped key apertures defining surfaces shaped to coact with the key wards to dispose the gates of said rim portions in alignment responsive to predetermined manipulation of the key and each center hub portion having a peripheral cylindrical bearing surface portion projecting beyond a side of its associated rim portion, supporting formations interposed between successive adjacent pairs of tumbler wheels defining spacers supported from the lock case outwardly of the tumbler wheel peripheries and having circular openings sized to receive the hub bearing surface portions journaled in nested relation therein to rotatably support the tumbler wheels about a common center axis, a control cam mechanism rotatable about said axis by the key inserted in the lock, a fence lever pivoted to a bolt having a depending nose adjacent the periphery of the control cam mechanism and a fence normally spaced above the tumbler wheel peripheries, and the control cam mechanism having means to link with said fence lever for retracting the bolt at a predetermined position when the tumbler wheel gates are positioned to receive the fence.

2. A key lock as defined in claim 1, wherein said supporting formations for the tumbler wheel hub portions are a plurality of stacked thin spacer sheet members having a circular center opening of a diameter corresponding to the diameter of said hub bearing surface portions receiving the latter projecting therethrough, said lock having a plurality of post members spaced outwardly adjacent the peripheries of said tumbler wheels and said sheet members having formations engaging said posts in supported relation therebetween.

3. A tumbler wheel type key lock as defined in claim 1, wherein the tumbler wheels each include interlocking jaw means releasably interlocking the rim portions with the hub portions, and said rim portions including a change key cam for receiving a change key therein and movable to positions to activate said interlocking jaw means to release the hub portions to assume different angular postions relative to their companion rim portions permitting resetting of the lock to different key ward configurations.

4. A tumbler wheel type key lock as defined in claim 2, wherein the tumbler wheels each include interlocking jaw means releasably interlocking the rim portions with the hub portions, and said rim portions including a change key cam for receiving a change key therein and movable to positions to activate said interlocking jaw means to release the hub portions to assume different angular postions relative to their companion rim portions permitting resetting of the lock to different key ward configurations.

5. A tumbler wheel type key lock as defined in claim 1, wherein the rim portion of each tumbler wheel is an annular ring-like rim member outwardly surrounding the hub portion of thinner axial dimension than the hub portion and having a smooth circular bounding edge along most of its center opening interrupted by a serrated surface jaw portion, said hub portion having a tubular cylindrical outer peripheral wall of greater axial thickness than the rim portion provided with a circular serrated band along one portion of its perimeter to lie within and register axially with the center opening of the rim portion with its serrations engaged by the serrated edge of said jaw formation and said hub bearing surface having a smooth circular band portion adjacent said serrated band portion projecting beyond a side face of said rim portion to extend through a corresponding circular center opening in and be supported by a respective one of the tumbler wheel hub supporting formations.

6. A tumbler wheel type key lock as defined in claim 2, wherein the rim portion of each tumbler wheel is an annular ring-like rim member outwardly surrounding the hub portion of thinner axial dimension than the hub portion and having a smooth circular bounding edge along most of its center opening interrupted by a serrated surface jaw portion, said hub portion having a tubular cylindrical outer peripheral wall of greater axial thickness than the rim portion provided with a circular serrated band along one portion of its perimeter to lie within and register axially with the center opening of the rim portion with its serrations engaged by the serrated edge of said jaw formation and said hub bearing surface having a smooth circular band portion adjacent said serrated band portion projecting beyond a side face of said rim portion to extend through a corresponding circular center opening in and be supported by a respective one of the tumbler wheel hub supporting formations.

7. A tumbler wheel type key lock as defined in claim 3, wherein the rim portion of each tumbler wheel is an annular ring-like rim member outwardly surrounding the hub portion of thinner axial dimension than the hub portion and having a smooth circular bounding edge along most of its center opening interrupted by a serrated surface jaw portion, said hub portion having a tubular cylindrical outer peripheral wall of greater axial thickness than the rim portion provided with a circular serrated band along one portion of its perimeter to lie within and register axially with the center opening of the rim portion with its serrations engaged by the serrated edge of said jaw formation and said hub bearing surface having a smooth circular band portion adjacent said serrated band portion projecting beyond a side face of said rim portion to extend through a corresponding circular center opening in and be supported by a respective one of the tumbler wheel hub supporting formations.

8. A tumbler wheel type key lock as defined in claim 4, wherein the rim portion of each tumbler wheel is an annular ring-like rim member outwardly surrounding the hub portion of thinner axial dimension than the hub portion and having a smooth circular bounding edge along most of its center opening interrupted by a serrated surface jaw portion, said hub portion having a tubular cylindrical outer peripheral wall of greater axial thickness than the rim portion provided with a circular serrated band along one portion of its perimeter to lie within and register axially with the center opening of the rim portion with its serrations engaged by the serrated edge of said jaw formation and said hub bearing surface having a smooth circular band portion adjacent said serrated band portion projecting beyond a side face of said rim portion to extend through a corresponding circular center opening in and be supported by a respective one of the tumbler wheel hub supporting formations.

9. A tumbler wheel type key lock as defined in claim 5, wherein said cylindrical peripheral wall of each tumbler wheel hub includes a shoulder-forming flange adjoining said serrated band portion at the side thereof opposite said cylindrical band portion to abut the side of said rim portion opposite the side from which said cylindrical band portion projects and said hub cylindrical peripheral wall including a cylindrical well receiving a portion of the cylindrical band portion of the adjacent hub member in internested relation therein.

10. A tumbler wheel type key lock as defined in claim 6, wherein said cylindrical peripheral wall of each tumbler wheel hub includes a shoulder-forming flange adjoining said serrated band portion at the side thereof opposite said cylindrical band portion to abut the side of said rim portion opposite the side from which said cylindrical band portion projects and said hub cylindrical peripheral wall including a cylindrical well receiving a portion of the cylindrical band portion of the adjacent hub member in internested relation therein.

11. A tumbler wheel type key lock as defined in claim 7, wherein said cylindrical peripheral wall of each tumbler wheel hub includes a shoulder-forming flange adjoining said serrated band portion at the side thereof opposite said cylindrical band portion to abut the side of said rim portion opposite the side from which said cylindrical band portion projects and said hub cylindrical peripheral wall including a cylindrical well receiving a portion of the cylindrical band portion of the adjacent hub member in internested relation therein.

12. A tumbler wheel type key lock as defined in claim 8, wherein said cylindrical peripheral wall of each tumbler wheel hub includes a shoulder-forming flange adjoining said serrated band portion at the side thereof opposite said cylindrical band portion to abut the side of said rim portion opposite the side from which said cylindrical band portion projects and said hub cylindrical peripheral wall including a cylindrical well receiving a portion of the cylindrical band portion of the adjacent hub member in internested relation therein.

13. A tumbler wheel key lock as defined in claim 1, wherein said control cam mechanism comprises a substantially cylindrical cam plate member to be rotated by the key and an inhibition disc of corresponding diameter supported against the plate member for limited relative rotation about said common axis, the cam plate member and inhibition disc each having a normally nonaligned peripheral gate recess and being relatively rotatable to align their gates for receiving the fence lever nose therein to retract the bolt when the tumbler wheel gates are in predetermined alignment with the fence, spring means biasing said inhibition disc to a relative position closing the plate member gate against entry of the fence lever nose, restraint means on the inhibition disc to be engaged by the fence lever nose during cam plate member rotation for restraining the inhibition disc during a predetermined extent of such cam plate member rotation causing tensioning of the spring means, and abutment formations interengageable at a precise relative displacement of said disc and plate member overcoming the restraint and momentarily aligning said gate recesses to receive the fence lever nose therein during spring return of the inhibition disc to its normal nonalignment position.

14. A tumbler wheel key lock as defined in claim 2, wherein said control cam mechanism comprises a substantially cylindrical cam plate member to be rotated by the key and an inhibition disc of corresponding diameter supported against the plate member for limited relative rotation about said common axis, the cam plate member and inhibition disc each having a normally nonaligned peripheral gate recess and being relatively rotatable to align their gates for receiving the fence lever nose therein to retract the bolt when the tumbler wheel gates are in predetermined alignment with the fence, spring means biasing said inhibition disc to a relative position closing the plate member gate against entry of the fence lever nose, restraint means on the inhibition disc to be engaged by the fence lever nose during cam plate member rotation for restraining the inhibition disc during a predetermined extent of such cam plate member rotation causing tensioning of the spring means, and abutment formations interengageable at a precise relative displacement of said disc and plate member overcoming the restraint and momentarily aligning said gate recesses to receive the fence lever nose therein during spring return of the inhibition disc to its normal nonalignment position.

15. A tumbler wheel key lock as defined in claim 4, wherein said control cam mechanism comprises a substantially cylindrical cam plate member to be rotated by the key and an inhibition disc of corresponding diameter supported against the plate member for limited relative rotation about said common axis, the cam plate member and inhibition disc each having a normally nonaligned peripheral gate recess and being relatively rotatable to align their gates for receiving the fence lever nose therein to retract the bolt when the tumbler wheel gates are in predetermined alignment with the fence, spring means biasing said inhibition disc to a relative position closing the plate member gate against entry of the fence lever nose, restraint means on the inhibition disc to be engaged by the fence lever nose during cam plate member rotation for restraining the inhibition disc during a predetermined extent of such cam plate member rotation causing tensioning of the spring means, and abutment formations interengageable at a precise relative displacement of said disc and plate member overcoming the restraint and momentarily aligning said gate recesses to receive the fence lever nose therein during spring return of the inhibition disc to its normal nonalignment position.

16. A tumbler wheel key lock as defined in claim 5, wherein said control cam mechanism comprises a substantially cylindrical cam plate member to be rotated by the key and an inhibition disc of corresponding diameter supported against the plate member for limited relative rotation about said common axis, the cam plate member and inhibition disc each having a normally nonaligned peripheral gate recess and being relatively rotatable to align their gates for receiving the fence lever nose therein to retract the bolt when the tumbler wheel gates are in predetermined alignment with the fence, spring means biasing said inhibition disc to a relative position closing the plate member gate against entry of the fence lever nose, restraint means on the inhibition disc to be engaged by the fence lever nose during cam plate member rotation for restraining the inhibition disc during a predetermined extent of such cam plate member rotation causing tensioning of the spring means, and abutment formations interengageable at a precise relative displacement of said disc and plate member overcoming the restraint and momentarily aligning said gate recesses to receive the fence lever nose therein during spring return of the inhibition disc to its normal nonalignment position.

17. A tumbler wheel key lock as defined in claim 9, wherein said control cam mechanism comprises a substantially cylindrical cam plate member to be rotated by the key and an inhibition disc of corresponding diameter supported against the plate member for limited relative rotation about said common axis, the cam plate member and inhibition disc each having a normally nonaligned peripheral gate recess and being relatively rotatable to align their gates for receiving the fence lever nose therein to retract the bolt when the tumbler wheel gates are in predetermined alignment with the fence, spring means biasing said inhibition disc to a relative position closing the plate member gate against entry of the fence lever nose, restraint means on the inhibition disc to be engaged by the fence lever nose during cam plate member rotation for restraining the inhibition disc during a predetermined extent of such cam plate member rotation causing tensioning of the spring means, and abutment formations interengageable at a precise relative displacement of said disc and plate member overcoming the restraint and momentarily aligning said gate recesses to receive the fence lever nose therein during spring return of the inhibition disc to its normal nonalignment position.

18. A tumbler wheel key lock as defined in either of claims 13, 14 or 15 or 16 or 17, wherein said restraint means on the inhibition disc comprises an outwardly projecting ramp formation immediately adjoining one side of the gate recess in said inhibition disc which is engaged and held against rotation during rotation of the cam plate member by the fence lever nose for an extent of relative movement of the cam plate member and inhibition disc until the spring force of said spring means is sufficient to overcome the restraint and force the ramp formation under the fence lever nose, thereby momentarily aligning the inhibition disc gate with the plate member gate in position to receive the fence lever nose.

19. A tumbler wheel type key lock as defined in claim 1, wherein the key lock is operable by a key having an elongated shank and a plurality of wards projecting diametrically oppositely along a plane including the center axis of the shank, the portions of the wards to coact with said shaped surfaces of the center hub portions of said tumbler wheels having end cuts at different radial distances from the axis of the key shank in accordance with a predetermined key code and the radially outer end portions of the wards having side cuts therein of predetermined depths in directions perpendicular to said diametric plane in accordance with a predetermined key code.

20. A tumbler wheel type key lock as defined in claims 2 or 4 or 5 or 9, wherein the key lock is operable by a key having an elongated shank and a plurality of wards projecting diametrically oppositely along a plane including the center axis of the shank, the portions of the wards to coact with said shaped surfaces of the center hub portions of said tumbler wheels having end cuts at different radial distances from the axis of the key shank in accordance with a predetermined key code and the radially outer end portions of the wards having side cuts therein of predetermined depths in directions perpendicular to said diametric plane in accordance with a predetermined key code.

* * * * *